US012601092B2

(12) United States Patent
Henry et al.

(10) Patent No.: US 12,601,092 B2
(45) Date of Patent: Apr. 14, 2026

(54) FLUOROPOLYMER FIBER-BONDING AGENT AND ARTICLES PRODUCED THEREWITH

(71) Applicant: Arkema Inc., King of Prussia, PA (US)

(72) Inventors: James J. Henry, Downingtown, PA (US); James T. Goldbach, Paoli, PA (US); Sean M. Stabler, Pottstown, PA (US)

(73) Assignee: Arkema Inc., King of Prussia, PA (US)

( * ) Notice: Subject to any disclaimer, the term of this patent is extended or adjusted under 35 U.S.C. 154(b) by 524 days.

(21) Appl. No.: 15/777,355

(22) PCT Filed: Nov. 16, 2016

(86) PCT No.: PCT/US2016/062222
§ 371 (c)(1),
(2) Date: May 18, 2018

(87) PCT Pub. No.: WO2017/087484
PCT Pub. Date: May 26, 2017

(65) Prior Publication Data

US 2020/0048805 A1 Feb. 13, 2020

Related U.S. Application Data

(60) Provisional application No. 62/257,344, filed on Nov. 19, 2015.

(51) Int. Cl.

| | |
|---|---|
| ***D04H 1/4318*** | (2012.01) |
| ***D01D 5/08*** | (2006.01) |
| ***D04H 1/52*** | (2006.01) |
| ***D04H 1/541*** | (2012.01) |
| ***D04H 1/587*** | (2012.01) |
| ***D04H 1/645*** | (2012.01) |

(52) U.S. Cl.
CPC ..... *D04H 1/4318* (2013.01); *D01D 5/08* (2013.01); *D04H 1/52* (2013.01); *D04H 1/5412* (2020.05); *D04H 1/5418* (2020.05); *D04H 1/587* (2013.01); *D04H 1/645* (2013.01)

(58) Field of Classification Search
CPC .... C09J 127/16; C09D 127/16; B32B 27/304; B32B 5/022; B32B 7/04; B32B 7/12; D04H 1/4318; D04H 1/541; D04H 1/52; D04H 1/587; D04H 1/645; D04H 1/64; D04H 1/65
See application file for complete search history.

(56) References Cited

U.S. PATENT DOCUMENTS

| | | | | |
|---|---|---|---|---|
| 4,521,483 | A * | 6/1985 | Sasaki | D01F 8/10 264/172.15 |
| 5,662,728 | A | 9/1997 | Groeger | |
| 6,174,601 | B1 * | 1/2001 | Stanitis | D01F 8/06 264/172.15 |
| 6,187,885 | B1 | 2/2001 | Barber | |
| 6,433,093 | B2 | 8/2002 | Lee et al. | |
| 6,479,143 | B1 | 11/2002 | Tamaru et al. | |
| 6,703,122 | B2 * | 3/2004 | Zhou | D01F 8/06 428/370 |
| 9,132,390 | B2 | 9/2015 | Cote | |
| 2007/0054579 | A1 * | 3/2007 | Baker, Jr. | B32B 5/02 442/364 |
| 2008/0023385 | A1 | 1/2008 | Baker, Jr. et al. | |
| 2011/0166278 | A1 | 7/2011 | Hochstetter et al. | |
| 2012/0224897 | A1 | 9/2012 | Qi et al. | |
| 2017/0051442 | A1 * | 2/2017 | Endle | D04H 1/64 |
| 2017/0088989 | A1 | 3/2017 | Goldbach et al. | |

FOREIGN PATENT DOCUMENTS

| | | |
|---|---|---|
| EP | 1674255 | 10/2007 |
| EP | 2174783 | 11/2011 |
| JP | 1306617 | 12/1989 |
| WO | WO 2013066022 | 5/2013 |

OTHER PUBLICATIONS

Table 2. Plastics Material Properties (Metric Units) MatWeb Plastic Material Data Sheets (Year: 2010).*
Sybille Chaix; New high fluidity Kynar 705 for PVDF ultra resistant mono and multifilaments fibers; Arkema Press Release; Aug. 20, 2012; 1 pg.
Stabler et al; Polyvinylidene fluoride fibres for multiple high performance uses; Filtration & Separation; Feb. 1, 2014; 4 pgs.

* cited by examiner

*Primary Examiner* — Jenna N Chandhok
(74) *Attorney, Agent, or Firm* — Joanne Rossi

(57) ABSTRACT

The invention relates to a melt-processable fiber-bonding agent made of poly(vinylidene fluoride) (PVDF), such as KYNAR® PVDF from Arkema, as well as to fibrous materials bonded with the PVDF fiber-bonding agent. The PVDF fiber-bonding agent is a low-melt temperature, low melt viscosity PVDF polymer or copolymer with excellent chemical and oxidative resistance properties, and is suitable for bonding fibers in non-woven fabrics, especially for use in chemically-aggressive environments. The PVDF fiber-bonding agent composition allows it to be processed into fibers on conventional melt spinning equipment. The PVDF fiber-bonding agent is introduced into non-woven fabric in the form of a continuous fiber web or as a component of a mixed fiber formulation. When heated above its melting point, the lower melting point PVDF fiber-bonding agent of the invention bonds the fibers of the fiber framework at the fiber cross-over points.

17 Claims, No Drawings

FLUOROPOLYMER FIBER-BONDING AGENT AND ARTICLES PRODUCED THEREWITH

This application claims benefit, under U.S.C. § 119 or § 365 of PCT Application Number PCT/US2016/062222, Nov. 16, 2016; and U.S. Provisional Application No. 62/257,344, filed Nov. 19, 2015; said applications incorporated herein by reference.

FIELD OF THE INVENTION

The invention relates to a melt-processable fiber-bonding agent made of poly(vinylidene fluoride) (PVDF), as well as to materials bonded with the PVDF bonding agent. The PVDF bonding agent is a low-melt temperature, high melt flow PVDF polymer or copolymer with excellent chemical and oxidation-resistance properties, and is suitable for bonding fibers in fabrics, especially for use in chemically-aggressive environments. The PVDF bonding agent composition allows it to be processed into fibers on conventional melt spinning equipment, and can be introduced into a composite woven and/or non-woven fabric in the form of fibers, a fiber web or as a component of fibers or a fiber web. When heated above its melting point, the lower melting point PVDF bonding agent of the invention, melts and bonds the fibers of the fiber composite framework, particularly at the cross-over points, improving mechanical strength of the final, bonded composite material.

BACKGROUND OF THE INVENTION

Fibers in a non-woven material are generally bound together to improve its physical properties. Bonding can be done by point-bonding the fibers together, where the fibers are heated and fused at regularly spaced points. The disadvantage of this process is that it reduces the available active area of the article and damages the fibers. Adhesive polymers can also be used, where an adhesive polymer flows to points of overlap of fibers, fusing the fibers as it dries. The use of a fiber-bonding agent for producing composite fiber articles is known and practiced commercially. In general, composite fiber materials can be produced by combining a low temperature polymer into or onto a "higher temperature" woven or nonwoven structure. The low temperature polymer is later melted to adhere to and penetrate the interstitial spaces between the fibers, creating bonding points. The low temperature polymer can be coextruded (as a molten polymer blend) with the primary fibers, can be extruded separately but concurrently with the primary fibers, or can be subsequently blended into a fiber structure (as in the form of a staple fiber). Activation of the fabric-bonding agent is commonly done using a hot calendar roll. Activation temperature is set sufficiently high to melt the fabric-bonding agent without melting the higher temperature primary fibers. Commonly, polyolefins (especially low-melting point polyethylene) are used as finer-bonding agents. These are either polyolefin fibers, or a multicomponent fiber with a polyethylene coextruded over a polypropylene or polyester fiber. Once the bonding agent/fiber composite is formed, the composite is heated above the melting point of the lower-melting point component to bond that fiber to an adjoining fiber. When polyolefins are used in such constructions, it is realized that they have limited chemical and oxidative resistance, and could deteriorate in a chemically-aggressive environment, resulting in degradation and loss of integrity of the composite material.

U.S. Pat. No. 5,662,728 describes the use of low melting point polyamide fibers as fabric-bonding agents to form a 3-dimensional fibrous framework. The fibers and fiber-bonding agent are of the same material—a sheath/core heterofilament fiber having a polyamide sheath and a polyester core. The fiber-bonding agent polyamides have melting points at least 20° C. lower than the polyamides sheath fibers in the fibrous framework. Other examples of bicomponent fibers having a low melting point sheath and a higher melting point core include US 2007/0054579 and US 2008/0023385.

Another method used to produce a higher melting point fiber "core" with a lower melting point "sheath" is to solution coat the core fiber with a solution of the lower melting point polymer. This involves additional processing steps, and the effluent solvent needs to be removed and vented or recovered. Examples of this method for use with a fluoropolymer fiber can be found in EP 2174783 and EP 1674255.

Fluoropolymer fibers formed from a solution or emulsion are described in U.S. Pat. No. 6,479,143 and WO 2013066022. These meltable fluoropolymer fibers can be blended with other fibers, both organic and inorganic, and processed to form a bonded non-woven material.

None of the fiber-bonding agents in the art are both fluoropolymers, and capable of being processed-on and formed-by conventional melt-processing equipment.

There is a need for a fluoropolymer fiber-bonding agent, with its excellent chemical and oxidative properties, that can be melt extruded into a fiber or fiber web on conventional equipment.

Low melting point, low viscosity poly(vinylidene fluoride) polymers and copolymers have now been produced, that are suitable for melt-processing on conventional melt fiber spinning equipment. Surprisingly, these fibers can be used as fiber-bonding agents, and provide exceptional chemical and oxidative resistance, compared to similar non-fluoropolymer fiber-bonding agents. The fluoropolymer fiber-bonding agent is especially useful in non-wovens for use in harsh chemical and/or oxidative environments, such as those formed of fluoropolymer and polyamide fibers.

SUMMARY OF THE INVENTION

The invention relates to a poly(vinylidene fluoride) (PVDF) composition that can be melt-processed into fibers, or as a component of a fiber by a melt-blowing process. The fibers are particularly useful as fiber-bonding agents in non-wovens. The PVDF has a melt viscosity of 0.01 to below 2.0 kP, at 100 $s^{-1}$ and 230° C., as measured by parallel plate rheology, and has a weight-average molecular weight of from 5,000 to 200,000 Dalton as measured by GPC.

The invention further relates to nonwoven materials formed from a blend of inorganic and/or organic fibers and the fiber-bonding agent of the invention.

Within this specification embodiments have been described in a way which enables a clear and concise specification to be written, but it is intended and will be appreciated that embodiments may be variously combined or separated without parting from the invention.

For example, it will be appreciated that all preferred features described herein are applicable to all aspects of the invention described herein.

Aspects of the invention include:

1. A fibrous composite material comprising primary fibers and a fiber-bonding agent composition, wherein said fiber-bonding agent composition comprises a melt-processed fluoropolymer, said fluoropolymer being a homopolymer or a copolymer comprising at least 60 weight percent of vinylidene fluoride monomer units, wherein said fluoropolymer composition has a melt viscosity of from 10 to 5,000 poise, as measured at 100 $s^{-1}$ and 230° C. by capillary rheology, and wherein said fluoropolymer has a second heat melting point of from 110° C. to 180° C. as measured by DSC, and wherein said fiber-bonding agent composition has a melting point of at least 10° C. below, preferably at least 15° C. below, and more preferably at least 20° C. below the melting point of the primary fibers.

2. The fibrous composite material of aspect 1, wherein said fluoropolymer fiber-bonding agent is a copolymer comprising 65 weight percent or more of vinylidene fluoride monomer units, and from 10 to 35 weight percent of hexafluoropropene monomer units.

3. The fibrous material of aspects 1 and 2, wherein said fluoropolymer is a copolymer of vinylidene fluoride, and one or more comonomers selected from the group consisting of tetrafluoroethylene, trifluorethylene, vinyl fluoride, chlorotrifluoroethylene, bromotrifluoroethylene, perfluoro(2-bromoethyl vinyl ether), hexafluoropropylene, hexafluoroisobutylene, octafluoroisobutylene, 1,1-dichloro-1,1-difluoroethylene, 1,2-dichloro-1,2difluorethylene, 1,1,1,-trifluoropropene, 1,3,3,3-tetrafluoropropene, 2,3,3,3-tetrafluoropropene, 1-chloro-3,3,3-trifluoropropene, hexafluorobutadiene, and perfluoroalkyl vinyl ethers (alkyl from C1 to C12).

4. The fibrous material of any of aspects 1-3, wherein said fiber-bonding agent composition further comprises one or more additives selected from the group consisting of plasticizers; inorganic fillers, talc, calcium carbonate, inorganic fiber and nanofibers, glass fibers, carbon fibers, carbon nanotubes; pigments; dyes, colorants; antioxidants; impact modifiers; surfactants; dispersing aids; compatible or incompatible non-fluoropolymers, acrylic polymers and copolymers; adhesion promoters, cross-link promoters, slip agents, rheology modifiers, thermal activation promoters, carbon black, and solvents.

5. The fibrous material of any of aspects 1-4, wherein the melt viscosity of said fluoropolymer fiber-bonding agent composition is from 1,000 to 5,000 poise.

6. The fibrous material of aspects 1-4, wherein the melt viscosity of said fluoropolymer composition is from 10 to less than 1,000 poise.

7. The fibrous material of any of aspects 1-6, wherein said fiber-bonding agent composition is a fiber in the form of a continuous fiber, a non-continuous fiber a staple fiber, a monofilament fiber, or a multifilament fiber.

8. The fibrous material of aspect 7, wherein said multifilament fiber comprises the primary fiber as the core, surrounded by the fiber-bonding composition.

9. The fibrous material of aspects 7 and 8, wherein said melt-processed polyvinylidene fluoride polymer has been melt-processed into a fiber by a melt spinning process selected from the group consisting of monofilament extrusion, multifilament extrusion, melt blowing, spunbond, solvent spinning, electrospinning.

10. The non-woven fibrous material of aspect 1, wherein said fiber-bonding agent is present in the fibrous material at from 1 to 49 percent by weight.

11. A process for forming the composite material of aspect 1, comprising the steps of combining said fiber-bonding agent and said primary fibers, followed by a step of activating said fiber-bonding agent to form bonds between said fiber-bonding agent and said primary fiber.

12. The process of aspect 11, wherein said activation is caused by imposing an activation agent to the material, wherein said activation agent is selected from heat, lamination roll, hot air oven, IR radiation, induction, laser, solvent, ultrasonic energy, UV radiation, gamma radiation, electron beam radiation.

13. A multi-component fiber comprising a primary fiber and a fiber-bonding agent, wherein said fiber-bonding agent composition is on the outside of said multi-component fiber, and said fiber-bonding agent comprises a melt-processed fluoropolymer, said fluoropolymer being a homopolymer or a copolymer comprising at least 60 weight percent of vinylidene fluoride monomer units, wherein said fluoropolymer composition has a melt viscosity of from 10 to 5,000 poise as measured at 100 $s^{-1}$ and 230° C. by capillary rheology, and wherein said fluoropolymer has a second heat melting point of from 110° C. to 180° C. as measured by DSC, and wherein said fiber-bonding agent composition has a melting point of at least 10° C. below the melting point of the primary fibers.

DETAILED DESCRIPTION OF THE INVENTION

The invention relates to PVDF fiber-bonding agents that can be formed into a fiber web in a melt-blowing process, and their use as a bonding agent in composite fibrous materials All references cited herein are incorporated by reference. Unless otherwise stated, all molecular weights are weight average molecular weights as determined by Gel Permeation Chromatography in DMF/0.003M LiBr solvent at room temperature, vs. poly(methyl methacrylate) narrow standard calibration, and all percentages are percentage by weight. Melt viscosities are determined by capillary rheometry or parallel plate rheometry at 230 C, and values reported are those taken at a shear rate of 100 $s^{-1}$.

The term "copolymer" as used herein indicates a polymer composed of two or more different monomer units, including two comonomers, three comonomers (terpolymers), and polymers having 4 or more different monomers. The copolymers may be random or block, may have a heterogeneous or homogeneous distribution of monomers, and may be synthesized by a batch, semi-batch or continuous process using neat monomer, solvent, aqueous suspension or aqueous emulsion as commonly known in the art.

Poly(Vinylidene Fluoride) Composition

The poly(vinylidene fluoride) (PVDF) composition used to form the fiber-bonding agent of the invention are vinylidene fluoride homopolymers, copolymers, or a blend of a PVDF homopolymer or copolymer with one or more other polymers that are compatible with the PVDF (co) polymer. PVDF copolymers of the invention are those in which vinylidene fluoride units comprise greater than 60 percent of the total weight of all the monomer units in the polymer, and more preferably, comprise greater than 70 percent of the total weight of the units. Copolymers, terpolymers and higher polymers of vinylidene fluoride may be made by reacting vinylidene fluoride with one or more monomers from the group consisting of tetrafluoroethylene, trifluorethylene, vinyl fluoride, chlorotrifluoroethylene, bromotrifluoroethylene, perfluoro(2-bromoethyl vinyl ether), hexafluoropropylene, hexafluoroisobutylene, octafluoroisobutylene, 1,1-dichloro-1,1-difluoroethylene, 1,2-dichloro-1,2difluorethylene, 1,1,1,-trifluoropropene, 1,3,3,3-tetrafluoropropene, 2,3,3,3-tetrafluoropropene, 1-chloro-3,3,3-trifluoropropene, hexafluorobutadiene, and perfluoroalkyl vinyl ethers (alkyl from C1 to C12).

In one embodiment, up to 35 wt %, preferably up to 30 wt %, and more preferably up to 15% by weight of hexafluoropropene (HFP) are present in the vinylidene fluoride copolymer. The HFP lowers the melting point of the copolymer, making it useful as a low melting point fiber-bonding agent for a wider range of fibers.

The composition of the fiber-bonding agent is dependent on the types of fibers it will be joining. The melting point of the fiber-bonding agent should be about 10° C. below the melting point of the primary fibers it will join, preferably at least 15° C. less, and more preferably at least 20° C. less. The melting point can be adjusted by varying the monomer composition, as is known in the art.

The PVDF used in the invention is generally prepared by means known in the art, using aqueous free-radical emulsion polymerization—although suspension, solution and supercritical $CO_2$ polymerization processes may also be used. In a general emulsion polymerization process, a reactor is charged with deionized water, water-soluble surfactant capable of emulsifying the reactant mass during polymerization and optional paraffin wax antifoulant. The mixture is stirred and deoxygenated. A predetermined amount of chain transfer agent, CTA, is then introduced into the reactor, the reactor temperature raised to the desired level and vinylidene fluoride (and possibly one or more comonomers) are fed into the reactor. Once the initial charge of vinylidene fluoride is introduced and the pressure in the reactor has reached the desired level, an initiator emulsion or solution is introduced to start the polymerization reaction. The temperature of the reaction can vary depending on the characteristics of the initiator used and one of skill in the art will know how to do so. Typically the temperature will be from about 30° to 150° C., preferably from about 60° to 120° C. Once the desired amount of polymer has been reached in the reactor, the monomer feed will be stopped, but initiator feed is optionally continued to consume residual monomer. Residual gases (containing unreacted monomers) are vented and the latex recovered from the reactor.

The fluoropolymers of the invention are low molecular weight, having a melt viscosity of 10 to 5,000 poise, preferably from 1,000 to 5,000 poise, with another preferred range of 10 to 1,000 poise, as measured at 100 $s^{-1}$ and 230° C., as measured by capillary rheology according to ASTM D3825. The fiber-bonding agent melt viscosity is below 5,000 poise to make it suitable for fiber melt spinning on conventional equipment. Lower viscosities are desired to improve processability, flowability and bonding characteristics. While the fluoropolymer may be of any physical structure, such as branched, star and comb, in a preferred embodiment the fiber-bonding agent is unbranched.

The weight average molecular weight of the fluoropolymer is from 15,000 to 200,000 Dalton, preferably from 15,000 to 100,000 Dalton, as measured by GPC in DMF/0.003M LiBr at room temperature, vs. poly(methyl methacrylate) narrow standard calibration. The second heat melting point of the PVDF composition is in the range of 110° C. to 180° C. as measured by differential scanning calorimetry (DSC).

Low molecular weight fluoropolymers of the invention can be obtained by using one or more chain transfer agent at high levels as compared to reaction processes used to generate high molecular weight engineering thermoplastics. Useful chain transfer agents include, but are not limited to C2 to C18 hydrocarbons like ethane, propane, n-butane, isobutane, pentane, isopentane, 2,2-dimethylpropane, and longer alkanes is isomers thereof. Also useful are alkyl and aryl esters such as pentaerythritol tetraacetate, methyl acetate, ethyl acetate, propyl acetate, iso-propyl acetate, ethyl propionate, ethyl isobutyrate, ethyl tert-butyrate, diethyl maleate, ethyl glycolate, benzyl acetate, C1-C16 alkyl benzoates, and C3-C18 cycloalkyl alkyl esters such as cyclohexyl acetate. Alcohols, carbonates, ketones, halocarbons, hydrohalocarbons, such as chlorocarbons, hydrochlorocarbons, chlorofluorocarbons, hydrochlorofluorocarbons, chlorosilanes and alkyl and aryl sulfonyl chlorides are also contemplated useful chain transfer agents. In one preferred embodiment a hydrocarbon or ester are used. The amount of chain-transfer agent can be from 0.01 to 30.0% of the total monomer incorporated into the reaction, preferably from 0.1 to 20.0% and most preferably from 0.2 to 10.0%. Chain-transfer agents may be added all at once at the beginning of the reaction, in portions throughout the reaction, or continuously as the reaction progresses or in combinations of these methods. The amount of chain-transfer agent and mode of addition which is used depends on the activity of the agent and the desired molecular weight characteristics of the product.

It is also envisioned that the polymerization could occur in a solvent system where the solvent acts as the chain transfer agent, or a solvent system with a functionally-inert solvent and an additional chain-transfer-active compound. Performing the reaction at higher temperatures would also be expected to produce lower molecular weight polymer, as would increasing the level of initiator.

The reaction can be started and maintained by the addition of any suitable initiator known for the polymerization of fluorinated monomers including inorganic peroxides, "redox" combinations of oxidizing and reducing agents, and organic peroxides. Examples of typical inorganic peroxides are the ammonium or alkali metal salts of persulfates, which have useful activity in the 65 C to 105 C temperature range. "Redox" systems can operate at even lower temperatures and examples include combinations of oxidants such as hydrogen peroxide, t-butyl hydroperoxide, cumene hydroperoxide, or persulfate, and reductants such as reduced metal salts, iron (II) salts being a particular example, optionally combined with activators such as sodium formaldehyde sulfoxylate or ascorbic acid. Among the organic peroxides which can be used for the polymerization are the classes of dialkyl peroxides, peroxyesters, and peroxydicarbonates. Exemplary of dialkyl peroxides is di-t-butyl peroxide, of peroxyesters are t-butyl peroxypivalate and t-amyl peroxypivalate, and of peroxydicarbonates are di(n-propyl) peroxydicarbonate, diisopropyl peroxydicarbonate, di(secbutyl)peroxydicarbonate, and di(2-ethylhexyl) peroxydicarbonate. The use of diisopropyl peroxydicarbonate for vinylidene fluoride polymerization and copolymerization with other fluorinated monomers is taught in U.S. Pat. No. 3,475,396, and its use in making vinylidene fluoride/hexafluoropropylene copolymers is further illustrated in U.S. Pat. No. 4,360,652. The quantity of an initiator required for a polymerization is related to its activity and the temperature used for the polymerization. The total amount of initiator used is generally between 0.05% to 2.5% by weight based on the total monomer weight used. Typically, sufficient initiator is added at the beginning to start the reaction and then additional initiator may be optionally added to maintain the polymerization at a convenient rate. The initiator may be added in pure form, in solution, in suspension, or in emulsion, depending upon the initiator chosen. As a particular example, peroxydicarbonates are conveniently added in the form of an aqueous emulsion.

The PVDF composition of the invention, capable of being melt-processed, contains one or more poly(vinylidene fluoride) polymers or copolymers, to achieve targeted properties (such as rheology or melting point). Optionally one or more additives including, but not limited to, plasticizers; inorganic fillers such as talc, calcium carbonate, inorganic fiber and nanofibers, including glass fibers, carbon fibers and carbon nanotubes; pigments; dyes and colorants; antioxidants; impact modifiers; surfactants; dispersing aids; compatible or incompatible non-fluoropolymers (such as acrylics); adhesion promoters, cross-link promoters, slip agents, rheology modifiers, thermal activation promoters (carbon black), and solvents as known in the art. Additives are generally used in the fluoropolymer composition at levels up to 40 weight percent based on the fluoropolymer, more preferably at a level of 0.01 to 30 weight percent, and more preferably from 0.1 to 20 weight percent. The additives can be introduced to the fluoropolymer composition by known means prior to melt processing, or during the melt processing operation.

Processing

Typical melt spinning processes include, but are not limited to, monofilament extrusion, multifilament extrusion, melt blowing, spunbond, solvent spinning, and electrospinning. Particularly, the process of meltblowing polymer resins has been known for many years and is widely used to generate nonwoven webs of fibers with fiber diameters <5 μm. The fluoropolymer composition of the invention has similar rheological behavior to polypropylene resins commonly used for meltblowing and may be used on equipment currently being used for producing such polypropylene fibers and nanofibers, with few, if any changes required. The fiber-bonding agents of the invention are produced using such equipment and are typically in the form of fibers themselves, though they could be used as a film, coating, fiber sizing or as a powder.

The fiber-bonding agent could be introduced into a non-woven composite structure using one or more of several techniques. In one embodiment, the fiber-bonding agent could be introduced as a second component in a bicomponent fiber, of which, different multicomponent fiber constructions could be used effectively. In one method, coextrusion is used to provide an outer layer composed of the fiber-bonding agent, over the primary fiber. Multi-layer-coated fibers could also be produced by coating the fiber-bonding agent onto the primary fiber by typical means such as spray coating, or dipping.

In another embodiment, concurrent fiber spinning is used, in which fibers of both the fiber-bonding agent and the primary fibers are each spun at the same time and blended together.

In another embodiment, the fiber-bonding agent is separately produced, then at a later time, introduced into a non-woven structure by mechanical mixing. A simple means of achieving this is by producing a fabric-bonding agent in the form of, or contained in, a staple fiber.

Once formed into a unified non-woven (composite) material, the fabric-bonding agent requires activation to create a multiplicity of bonds within the textile structure. This can be done using a lamination roll, hot air oven, IR, induction, laser or other thermal method. Solvent or ultrasonic activation could also be used to activate and melt the fiber-bonding agent to bond the primary fibers together.

In one embodiment, UV, electron beam or other radiation-initiated activation could be used. For example, perfluoro-4-bromo-1-butene or other similar monomer could be incorporated in the PVDF copolymer. The radiation source could then be used to activate and crosslink the fiber-bonding agent. Other cross-linking agent, such as peroxides could also be used to promote cross-linking of the fiber-bonding agent. Alternatively, functionality could be introduced into the PVDF copolymer, and/or into a compatible polymer in the fiber-bonding composition (such as an acrylic). The crosslinking could then be triggered by heat-activation.

The fiber-bonding agent is especially useful in forming a non-woven material using primary fibers that are also chemically and oxidatively resistant, such as poly(vinylidene fluoride) homopolymers and copolymers, and other fluoropolymers. It could also be useful in forming a non-woven structure with inorganic fibers, such as, but not limited to carbon fiber, glass fiber, asbestos, rock wool, metal fibers; and with heat resistant organic fibers, such as, but not limited to, poly(propylene sulfide), polyimides, polyamides, aramid fiber, polyethers, poly(ether ketone), poly(ether ether ketone), poly(ether ketone ketone), polycarbonates, poly(ether imides), and polystyrenics.

The fiber-bonding agent of the invention is also useful as a bonding agent for other fibrous materials, including woven fibrous materials, paper, fiberboard, wood, and wood by-products.

The fiber-bonding agent is used in the fibrous material with the primary fiber at from 1 to 49 weight percent, preferably at from 2 to 25 weight percent, and more preferably at from 5 to 15 weight percent.

In one embodiment, the fiber-bonding agent is used in a fiber-form with fibers that have a diameter that is smaller than the primary fibers, which facilitates better bonding.

EXAMPLES

Example 1: Meltblown Fabric Fiber Bonding Agent

VDF homopolymer having a viscosity of 0.11 kpoise measured on a capillary viscometer (232° C., 100 $s^{-1}$) was processed on a melt blown extrusion line to produce melt blown fabrics having various basis weights. The extrusion line consisted of a 1.5 inch Brabender single screw extruder outfitted with a standard metering screw. An Exxon style melt blown die having 120 holes having a diameter of 0.010 inches, a setback of 0.08 inches and an air gap of 0.60 inches was outfitted at the end of the extruder. Meltblown fibers were extruded at a targeted output of 0.27 grams per hole per minute (ghm) and collected on a moving belt. Process conditions were adjusted to produce samples of varied basis weight measured in grams per square meter (gsm) and fiber diameter measured in micrometers (μm) as shown in the following Table 1.

TABLE 1

| Fabric Sample | Extruder Temperature Zone 1 ° C. | Zone 2 ° C. | Zone 3 ° C. | Adapter ° C. | Die Temperature Zone 1 ° C. | Zone 2 ° C. | Screw Pressure PSI | Screw Speed rpm | Air Temp. ° F. | Air Pressure PSI | Collector Speed m/min | DCD cm | Basis Weight gsm | Fiber Diameter μm |
|---|---|---|---|---|---|---|---|---|---|---|---|---|---|---|
| 1 | 179 | 222 | 249 | 233 | 245 | 250 | 385 | 7 | 500 | 10 | 3.93 | 25 | 55 | 1.7 |
| 2 | 173 | 230 | 241 | 236 | 251 | 246 | 378 | 7 | 500 | 9 | 3.93 | 15 | 53 | 1.6 |
| 3 | 180 | 224 | 243 | 232 | 246 | 251 | 440 | 7 | 500 | 9 | 7.19 | 15 | 32 | 1.6 |
| 4 | 179 | 230 | 245 | 235 | 248 | 229 | 401 | 7 | 500 | 9 | 7.19 | 25 | 30 | 1.4 |
| 5 | 178 | 231 | 244 | 235 | 245 | 249 | 378 | 7 | 500 | 9 | 9.42 | 25 | 18 | 1.6 |
| 6 | 178 | 228 | 236 | 235 | 253 | 250 | 430 | 7 | 500 | 9 | 9.42 | 15 | 13 | 1.3 |

Example 2: Meltblown Fabric Fiber Bonding Agent

VDF-HFP copolymer having a melting point of 127° C. as measured by DSC and a viscosity of 0.40 kpoise measured on a capillary viscometer (232° C., 100 $s^{-1}$) was processed on a melt blown extrusion line to produce melt blown fabrics having various basis weights. The extrusion line consisted of a 1.5 inch Brabender single screw extruder outfitted with a standard metering screw. An Exxon style melt blown die having 120 holes having a diameter of 0.010 inches, a setback of 0.08 inches and an air gap of 0.60 inches was outfitted at the end of the extruder. Meltblown fibers were extruded at a targeted output of 0.27 grams per hole per minute (ghm) and collected on a moving belt. Process conditions were adjusted to produce samples of varied basis weight measured in grams per square meter (gsm) and fiber diameter measure in micrometers (μm) as shown in the following Table 2.

TABLE 2

| Fabric Sample | Extruder Temperature Zone 1 ° C. | Zone 2 ° C. | Zone 3 ° C. | Adapter ° C. | Die Temperature Zone 1 ° C. | Zone 2 ° C. | Screw Pressure PSI | Screw Speed rpm | Air Temp. ° F. | Air Pressure PSI | Collector Speed m/min | DCD cm | Basis Weight gsm | Fiber Diameter μm |
|---|---|---|---|---|---|---|---|---|---|---|---|---|---|---|
| 7 | 124 | 225 | 232 | 236 | 248 | 246 | 413 | 7 | 500 | 9 | 9.42 | 25 | 16 | 4.4 |

Example 3: Composite Laminated Fabric

A composite laminated fabric was produced using two layers of Fabric Sample 3 laminated together using a layer of Fabric Sample 7. The fabric samples were prepared by cutting into round 100 $cm^2$ sections using a circular paper cutter. The Fabric Sample 3 layers were conditioned by placing them between two Kapton polyimide sheets and then placed into a mold consisting of two stainless steel plates (6"×6"×0.100"). The mold was then placed into a hot press set at 135° C. for 2 minutes to allow the mold to reach press temperature. The application of pressure was performed by increasing the total pressure to 1000 psi and holding for 10 seconds then releasing the pressure. The mold was then removed from the press and the Kapton sheets containing the fabric removed from the mold and allowed to cool. Once cool, the Kapton sheets were removed. The thickness of the fabric samples after conditioning was measured to be between 0.007 and 0.009 inches. The composite fabric was then prepared by using two layers of Fabric Sample 3 and one layer of Fabric Sample 7 with Fabric Sample 3 comprising both the bottom and top layers. The composite structure was then placed between two Kapton sheets and the mold plates. The mold was placed into the hot press set at 135° C. for 2 minutes to allow the mold to reach press temperature. The application of pressure was done by increasing to 1000 psi total pressure and holding for 10 seconds then releasing the pressure. The mold was then removed from the press and the Kapton sheets containing the fabric removed from the mold and allowed to cool. Once cool, the Kapton sheets were removed. Inspection of the composite sheet indicated adhesion between the layers with the middle layer acting as an adhesive joining the upper and lower fabric layers. Melting of the inner fabric layer (Fabric Sample 7) was noted. No melting of the outer fabric layers (Fabric Sample 3) could be observed.

Example 4: Composite Laminated Fabric

The fabric lamination process as described in Example 3 was repeated with the exception that the middle fabric sample layer (Fabric Sample 7) was not included. The composite fabric produced using two layers of Fabric Sample 3 exhibited no bonding and could be easily separated. No melting was observed on the Fabric Sample 3.

Example 5: Composite Laminated Fabric

The composite laminated fabric described in Example 4 was repeated with the exception that the pressing temperatures were increased from 135° C. (below the melting point of Fabric Sample 3) to 170° C. (just above the melting point of fabric sample 3). The resultant fabric was found to be completely bonded but exhibited excessive melting and flow. The integrity of the fabric was degraded due to excessive melting of the fibers. In several areas, the fibers had melted and formed into a film.

Example 6: Composite Laminated Fabric

A composite laminated fabric was produced using two layers of a fabric comprised of ECTFE fibers laminated together using a layer of Fabric Sample 3. The fabric samples were prepared by cutting into 2"×2" sections using scissors. The ECTFE fabric layers were conditioned by placing between two Kapton sheets and then placed into a mold consisting of two stainless steel plates (6"×6"×0.100). The mold was then placed into a hot press set at 168° C. for 2 minutes to allow the mold to reach press temperature. The application of pressure was done by increasing to 1000 psi total pressure and holding for 10 seconds then releasing the pressure. The mold was then removed from the press and the Kapton sheets containing the fabric was removed from the mold and allowed to cool. Once cool, the Kapton sheets were removed. The composite fabric was then prepared by using two layers of ECTFE fabric and one layer of Fabric Sample 3 with the ECTFE fabric comprising both the bottom and top layers. The composite structure was then placed between two Kapton sheets and the mold plates. The mold was placed into the hot press set at 168° C. for 2 minutes to allow the mold to reach press temperature. The application of pressure was done by increasing to 1000 psi total pressure and holding for 10 seconds then releasing the pressure. The mold was then removed from the press and the Kapton sheets containing the fabric removed from the mold and allowed to cool. Once cool, the Kapton sheets were removed. Inspection of the composite sheet indicated adhesion between the layers with the middle layer acting as an adhesive joining the upper and lower fabric layers. Melting of the inner fabric layer (Fabric Sample 7) was noted. No melting of the outer fabric layers (Fabric Sample 3) could be observed.

Example 7

Materials

- PVDF meltblown fabric—avg. fiber diameter 0.9 micrometers
- Stainless Steel (SS) woven material—200 mesh
- PTFE expanded material—200 mesh
- Polyester (PET) woven—200 mesh
- Nylon woven—200 mesh
- Polypropylene (PP) mesh Equipment

- Carver presses, 6 in., 1 with heated platens, 1 with cooled platens (15 C)
- Werner force gauge (0-10 lbf) equipped with film grips (1 in. width)
- 304 Stainless steel plates, 1/16 in. thickness Procedure Materials were cut into 6 in.×6 in. squares and laid-up in a three- or four-layer construction between two 1/16 in-thickness stainless steel plates. Material constructions consisted of a bottom layer of woven material (stainless/PTFE/PET/or Nylon mesh), followed by one or two layers of PVDF meltblown, followed by another layer of mesh of the same material as the bottom layer. The heated Carver press was equilibrated at the desired temperature and full 'sandwich' was placed in the press for 2 min under the desired clamping force. Following the 2 min heating time, the sandwich was removed and placed in the cooled press for an additional 2 min under 140 psi pressure. The processed construction was then removed from the press and the stainless steel plates were removed. Sample strips of 1 in.×4 in. size were then cut from the center of the construction. The edges of the sample strips were slightly delaminated by-hand with the top and bottom layers then mounted in the film grips of the force gauge apparatus. The force gauge was then continually moved upwards, causing the laminated material to undergo a 180 degree peel. For each sample construction, the maximum observed (adhesive) force was recorded, and at least three replicates were processed in this way. Testing conditions and measured adhesive forces were recorded and are presented in Table 3.

TABLE 3

Testing conditions and adhesion data.

| Material | PVDF Meltblown Layers (#) | Press Temperature (deg. F.) | Pressing Force* (psi) | Averaged max. adhesive force** (lbf) |
|---|---|---|---|---|
| PTFE | 1 | 360 | 140 | 0.240 |
| | 1 | 360 | 28 | 0.167 |
| | 1 | 360 | 280 | 0.122 |
| | 1 | 330 | 28 | NB |
| | 2 | 360 | 140 | 0.274 |
| | 2 | 360 | 420 | 0.299 |
| Polyester | 1 | 330 | 140 | NB |
| | 1 | 340 | 140 | 0.043 |
| | 1 | 350 | 140 | 0.060 |
| | 2 | 350 | 140 | 0.143 |
| SS | 2 | 360 | 140 | 0.128 |
| | 2 | 380 | 140 | 0.075 |
| Nylon | 1 | 350 | 140 | .235 |
| PP | 1 | 350 | 140 | 3.55 |
| | 1 | 370 | 140 | Intractable† |
| | 1 | 380 | 140 | Intractable† |

*reported force as actual applied in pounds per square inch

**maximum measured adhesive force during 180° peel test on a 1 inch width sample, average of four separate measurements NB = no bond; layers separated without any applied peel force †layers were fused tightly and unable to separate to perform peel test Observations/Conclusions KYNAR® PVDF meltblown material acts as a good bonding agent for the wide-range of materials tested. There seems to be higher adhesion to PTFE and Nylon than polyester and stainless steel. Measured adhesion of PP mesh was very high, but could be due to partial melting/bonding of the PP itself, given the relatively similar melting points of PVDF (~170 C) and PP (~190 C). Heating above the melting point of PVDF (340 F) is a requirement to obtain any adhesive effect. Changing pressing force had little effect on the degree of bonding for the PTFE mesh case. The results strongly suggest that multi-layer constructions incorporating PVDF meltblowns are possible to be prepared and bonded using thermal bonding techniques, or that PVDF meltblown materials could be used as an adhesive layer.

What is claimed is:

1. A fibrous composite material comprising primary fibers and a fiber-bonding agent composition, wherein the said fiber-bonding agent composition comprises a melt-processable vinylidene fluoride polymer, said vinylidene fluoride polymer comprising a homopolymer or a copolymer containing at least 60 weight percent of vinylidene fluoride monomer units and one or more comonomer(s) selected from the group consisting of tetrafluoroethylene, trifluoroethylene, vinyl fluoride, chlorotrifluoroethylene, bromotrifluoroethylene, perfluoro (2-bromoethyl vinyl ether), hexafluoropropylene, hexafluoroisobutylene, octafluoroisobutylene, 1,1-dichloro-1,1-difluoroethylene, 1,2-dichloro-1,2difluoroethylene, 1,1,1,-trifluoropropene, 1,3,3,3-tetrafluoropropene, 2,3,3,3-tetrafluoropropene, 1-chloro-3,3,3-trifluoropropene, hexafluorobutadiene, and perfluoroalkyl vinyl ethers (alkyl from C1 to C12), wherein said vinylidene fluoride polymer has a melt viscosity of from 10 to 2000 poise as measured at 100 $s^{-1}$ and 230° C. by capillary rheology, and has a second heat melting point of from 110° C. to 180° C. as measured by DSC, and wherein said fiber-bonding agent composition has a melting point of at least 10° C. below the melting point of the primary fibers, and wherein said fibrous composite material is a non woven fabric and said fiber-bonding agent is present in the fibrous composite material at from 2 to 25 percent by weight, wherein the fiber bonding agent is in the form of a fiber and has a diameter that is less than the diameter of the primary fibers.

2. The fibrous composite material of claim 1, wherein said vinylidene fluoride polymer is a copolymer containing 65 weight percent or more of vinylidene fluoride monomer units, and from 10 to 35 weight percent of hexafluoropropene monomer units.

3. The fibrous composite material of claim 1, wherein said fiber-bonding agent composition has a melting point at least 15° C. below the melting point of the primary fibers.

4. The fibrous composite material of claim 3, wherein said fiber-bonding agent composition has a melting point at least 20° C. below the melting point of the primary fibers.

5. The fibrous composite material of claim 1, wherein said vinylidene fluoride polymer is a copolymer of vinylidene fluoride, and one or more comonomers selected from the group consisting of tetrafluoroethylene, trifluorethylene, vinyl fluoride, hexafluoropropylene, hexafluoroisobutylene, 1,1,1,-trifluoropropene, 1,3,3,3-tetrafluoropropene, 2,3,3,3-tetrafluoropropene, 1-chloro-3,3,3-trifluoropropene.

6. The fibrous composite material of claim 1, wherein said fiber-bonding agent composition further comprises one or more additives selected from the group consisting of plasticizers; inorganic fillers, talc, calcium carbonate, inorganic fiber and nanofibers, glass fibers, carbon fibers, carbon nanotubes; pigments; dyes, colorants; antioxidants; impact modifiers; surfactants; dispersing aids; compatible or incompatible non-fluoropolymers, acrylic polymers and copolymers; adhesion promoters, cross-link promoters, slip agents, rheology modifiers, thermal activation promoters, carbon black, and solvents.

7. The fibrous composite material of claim 1, wherein the melt viscosity of said vinylidene fluoride polymer is from 10 to less than 1,000 poise.

8. The fibrous composite material of claim 1, wherein said fiber-bonding agent composition is a fiber in the form of a continuous fiber, a non-continuous fiber, a staple fiber, a monofilament fiber, or a multifilament fiber.

9. The fibrous composite material of claim 8, wherein said fiber bonding agent composition has been melt-processed into a fiber by a melt spinning process selected from the group consisting of monofilament extrusion, multifilament extrusion, melt blowing, spunbond, solvent spinning, and electrospinning.

10. The fibrous composite material of claim 1, wherein said primary fibers are selected from the group consisting of carbon fiber, glass fiber, asbestos, rock wool, metal fibers, fluoropolymer, poly(propylene sulfide), polyimides, polyamides, aramid fiber, polyethers, poly(ether ketone), poly (ether ether ketone), poly(ether ketone ketone), polycarbonates, poly(ether imides), polystyrenics, cellulosics, wood, wood by-products, and paper.

11. A process for forming the composite material of claim 1, comprising the steps of combining said fiber-bonding agent and said primary fibers, followed by a step of activating said fiber-bonding agent to form bonds between said fiber-bonding agent and said primary fiber.

12. The process of claim 11, wherein said activation is caused by imposing an activation agent to the material, wherein said activation agent is selected from heat, lamination roll, hot air oven, IR radiation, induction, laser, solvent, ultrasonic energy, UV radiation, gamma radiation, electron beam radiation.

13. The fibrous composite material of claim 1, wherein said primary fibers are selected from the group consisting of carbon fiber, glass fiber, asbestos, rock wool, metal fibers, fluoropolymers, poly(propylene sulfide), polyimides, polyamides, polycarbonates, poly(ether imides), cellulosics, wood, wood by-products, and paper.

14. The fibrous composite material of claim 1, wherein said primary fibers comprises a fluoropolymer.

15. The fibrous composite material of claim 14, wherein said fluoropolymer is selected from the group consisting of polyvinylidene fluoride homopolymer and polyvinylidene fluoride copolymers and combinations thereof.

16. A fibrous composite material comprising primary fibers and a fiber-bonding agent composition, wherein the said fiber-bonding agent composition is present in the fibrous composite material at from 2 to 25 percent by weight and comprises a melt-processable vinylidene fluoride polymer, said vinylidene fluoride polymer comprising a homopolymer or a copolymer comprising at least 60 weight percent of vinylidene fluoride monomer units, wherein said vinylidene fluoride polymer has a melt viscosity of from 10 to 2000 poise as measured at 100 $s^{-1}$ and 230° C. by capillary rheology, and has a second heat melting point of from 110° C. to 180° C. as measured by DSC, and wherein said fiber-bonding agent composition has a melting point of at least 10° C. below the melting point of the primary fibers, wherein said fiber-bonding agent composition is a fiber in the form of a monofilament fiber.

17. A fibrous composite material comprising primary fibers and a fiber-bonding agent composition, wherein the said fiber-bonding agent composition comprises a melt-processable vinylidene fluoride polymer, said vinylidene fluoride polymer comprising a homopolymer or a copolymer containing at least 60 weight percent of vinylidene fluoride monomer units and one or more comonomer(s), wherein said vinylidene fluoride polymer has a melt viscosity of from 10 to 2000 poise as measured at 100 $s^{-1}$ and 230° C. by capillary rheology, and has a second heat melting point of from 110° C. to 180° C. as measured by DSC, and wherein said fiber-bonding agent composition has a melting point of at least 10° C. below the melting point of the primary fibers, is present in the fibrous composite material at from 2 to 25 percent by weight, is in the form of a fiber and has a diameter that is less than the diameter of the primary fibers.

* * * * *